US005099817A

United States Patent [19]

Nakaniwa

[11] Patent Number: 5,099,817

[45] Date of Patent: Mar. 31, 1992

[54] PROCESS AND APPARATUS FOR LEARNING AND CONTROLLING AIR/FUEL RATIO IN INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 622,237

[22] Filed: Dec. 6, 1990

[30] Foreign Application Priority Data

Dec. 6, 1989 [JP] Japan ..... 1-315454

[51] Int. Cl.[5] ..... F02D 41/14

[52] U.S. Cl. ..... 123/489

[58] Field of Search ..... 123/440, 489

[56] References Cited

U.S. PATENT DOCUMENTS 4,528,961 7/1985 Katoh et al. ..... 123/489
4,592,325 6/1986 Nakagawa ..... 123/489
4,644,921 2/1987 Kobayashi et al. ..... 123/489

FOREIGN PATENT DOCUMENTS 60-90944 5/1985 Japan .
61-190142 8/1986 Japan .

*Primary Examiner*—Tony M. Argenbright
*Attorney, Agent, or Firm*—Foley & Lardner

[57] ABSTRACT

Disclosed are a process and apparatus for learning and controlling the air/fuel ratio in an internal combustion engine, in which a feedback correction value for correcting a basic fuel supply quantity to bring the air/fuel ratio of an air/fuel mixture sucked in the engine close to the target air/fuel ratio is set and a learning correction value for each of driving regions is learned so as to reduce the deviation of the feedback correction value from the target convergent value, and in this control of learning and correcting the air/fuel ratio, the target convergent value is variably set based on engine-driving conditions and the like so that the basic air/fuel ratio obtained without feedback correction can be optionally changed.

14 Claims, 6 Drawing Sheets

PROCESS AND APPARATUS FOR LEARNING AND CONTROLLING AIR/FUEL RATIO IN INTERNAL COMBUSTION ENGINE

BACKGROUND OF THE INVENTION (1) Field of the Invention

The present invention relates to a process and apparatus for learning and controlling the air/fuel ratio in an internal combustion engine. More particularly, the present invention relates to learning the correction control of the air/fuel ratio for each driving region in an electronically controlled fuel supply apparatus having an air/fuel ratio feedback control function.

(2) Description of the Related Art

An air/fuel ratio learning correction control system as disclosed in Japanese Unexamined Patent Publication No. 60-90944 or Japanese Unexamined Patent Publication No. 61-190142 is adopted in certain internal combustion engines provided with an electronically controlled fuel supply apparatus having an air/fuel ratio feedback correction control function.

According to the air/fuel ratio feedback correction control, whether the air/fuel ratio of the practically sucked air/fuel mixture is rich or lean compared to the theoretical air/fuel ratio is indirectly detected based on the oxygen concentration in the exhaust gas detected by an oxygen sensor disposed in the exhaust system of the engine. An air/fuel ratio feedback correction coefficient LMD is increased or decreased and set based on the result of the above detection, and the basic fuel supply quantity is increased or decreased and corrected by this air/fuel ratio feedback correction LMD, whereby the actual air/fuel ratio is feedback-controlled to the theoretical air/fuel ratio.

In this control, the deviation of the air/fuel ratio feedback correction coefficient LMD from the reference value (the value not substantially performing any increase or decrease correction of the quantity of the fuel; for example, 1.0 when the correction coefficient is a multiplier term) is learned for each of a plurality of predetermined driving regions to determine a learning correction coefficient KBLRC, and by correcting the basic fuel injection quantity Tp by the learning correction coefficient KBLRC, the basic air/fuel ratio obtained by the final fuel injection quantity Ti computed without the air/fuel ratio feedback correction coefficient LMD is made substantially equal to the theoretical air/fuel ratio (target air/fuel ratio). Namely, by learning the deviation of the correction coefficient LMD from the reference value, the correction by the correction coefficient LMD is converted to the learning correction coefficient KBLRC, so that the correction coefficient LMD converges on the reference value, and therefore, the target convergent value of the correction coefficient LMD is the reference value.

During the air/fuel ratio feedback control, by performing the correction by the air/fuel ratio feedback correction coefficient LMD, the fuel injection quantity Ti is computed.

By this learning control, correction a meeting the requirements for correction of the air/fuel ratios, differing according to the driving condition, can be performed. Especially, in the case where the required correction value for the air/fuel ratio control is violently changed at the transient driving and there is a response delay in the correction by the air/fuel ratio correction coefficient LMD, the correction corresponding to the driving condition is performed by the learning correction coefficient KBLRC for each driving region and great deviation of the actual air/fuel ratio from the target air/fuel ratio is prevented.

In the low-revolution high-load driving region where hesitation is readily caused, it is more necessary than in other driving regions that hesitation at acceleration should be avoided by controlling the basic air/fuel ratio obtained without correction by the correction coefficient LMD to the rich side. However, in the conventional learning correction control, since such learning that the target air/fuel ratio (theoretical air/fuel ratio) in the air/fuel ratio feedback control can be obtained even without feedback control is not performed through the entire learning driving region, it is difficult to change the learned target air/fuel ratio in a certain driving region, and, therefore, impossible to satisfy the above-mentioned requirement.

More specifically, in the case where it is intended to perform such learning that the target air/fuel ratio is set at a value richer than the target air/fuel ratio (theoretical air/fuel ratio) obtained by the feedback control in a certain driving region, it is necessary to perform learning in this region by practically performing the feedback control to the above-mentioned richer target air/fuel ratio, and during this learning, the target air/fuel ratio by the inherent feedback control cannot be obtained and simultaneously it becomes necessary to detect the air/fuel ratio not only with respect to the target air/fuel ratio by the feedback control but also with respect to the above-mentioned richer learned air/fuel ratio, and therefore, it is impossible to change the target of learning of the air/fuel ratio to a richer or leaner side only in a certain region by simple means.

Because of not only the above-mentioned difference of the required learned target value among the driving regions but also the difference of the properties of the exhaust gas among engines, it is sometimes desired to set the basic air/fuel ratio obtained only by the learning correction without using the feedback correction at a level richer or leaner than the target air/fuel ratio for performing the feedback control, and for the reasons set forth above, this desire cannot be satisfied by simple means.

SUMMARY OF THE INVENTION

It is a primary object of the present invention to perform simple learning with an air/fuel ratio different from the target air/fuel ratio of the air/fuel ratio feedback control being the target, whereby the difference of the required basic air/fuel ratio among driving regions or engines can be coped with.

Another object of the present invention is to realize burning at an air/fuel ratio richer or leaner than the target air/fuel ratio in the ordinary feedback control in a predetermined driving region while coping with the difference of the required correction according to the driving condition.

In accordance with the present invention, these object can be attained by a process for learning and controlling the air/fuel ratio in an internal combustion engine, which comprises setting a basic fuel supply quantity based on engine driving conditions including at least a parameter participating in the quantity of air sucked in the air, comparing the air/fuel ratio of an air/fuel mixture actually sucked in the engine with the target air/fuel ratio, setting an air/fuel ratio feedback correction value for correcting the basic fuel supply quantity so that the actual air/fuel ratio is brought close to the target air/fuel ratio, variably setting the target convergent value of the air/fuel ratio feedback correction value, learning an air/fuel ratio learning value for each driving region of the engine so as to reduce the deviation of the air/fuel ratio feedback correction value from the target convergent value, renewing the learned value, storing the renewed value, setting a final fuel supply quantity based on the basic fuel supply quantity, the air/fuel ratio feedback correction value and the air/fuel ratio learning correction value of the corresponding driving region, and controlling the supply of the fuel to the engine based on the set final fuel supply quantity.

According to the process having the above-mentioned structure, the air-fuel ratio learning correction value is learned so that the air/fuel ratio feedback correction value converges on the target convergent value, and therefore, the learned target air/fuel ratio can be optionally deviated from the target air/fuel ratio of the feedback control by changing the target convergent value. For example, if the convergent target value is changed to the fuel quantity-increasing side, learning is performed toward an air/fuel ratio leaner than the above-mentioned target value. In contrast, if the convergent target value is changed to the fuel quantity-decreasing side, learning is performed toward an air/fuel ratio richer than the above-mentioned target air/fuel ratio. Accordingly, while performing the feedback control to one target air/fuel ratio by the air/fuel ratio feedback correction value, learning can be performed toward an optional air/fuel ratio different from the above-mentioned target air/fuel ratio, which need not be detected.

In the above-mentioned structure, a modification can be made so that when learning correction of the air/fuel ratio learning correction value converges after changeover of the target convergent value, the air/fuel ratio feedback correction value is forcibly clamped at the initial value.

If the air/fuel ratio feedback correction value is clamped after the convergency of the learning corresponding to the changeover of the target convergent value and the correction of the air/fuel ratio is performed only by the air/fuel ratio learning correction value, the air/fuel ratio is controlled to the learning target of the air/fuel ratio learning correction value. Namely, if the convergent target value is changed toward a fuel quantity-increasing side, the air/fuel learning correction value is changed toward the correction of further reducing the fuel quantity, and therefore, by the correction only by the air/fuel learning correction value, the air/fuel ratio is corrected to a level leaner than the target air/fuel ratio and the lean burning control becomes possible.

In the case where the convergent target value of the air/fuel ratio feedback correction value is variably set as mentioned above, the variable setting can be accomplished based on the revolution speed of the engine and the engine load. In this case, for example, in a driving region where hesitation is readily caused, it is possible to make the basic air/fuel ratio richer.

If the above-mentioned convergent value is variably set based on the engine temperature, for example, by correcting the target convergent value to the fuel quantity-decreasing side when the engine is cold, the basic air/fuel ratio can be made richer when the air is cold.

Furthermore, there can be adopted a modification in which a plurality of maps where a target convergent value is stored according to a driving region of the engine are provided and the target convergent value is variably set according to the map selected based on the requirement of the basic air/fuel ratio among these maps. In this case, in one driving region, different basic air/fuel ratios can be learned according to the selection of the maps.

Furthermore, if the target convergent value is variably set based on whether the running speed of an engine-loaded vehicle is constant or not, for example, the basic air/fuel ratio at the stationary running can be made leaner.

Moreover, in the learning of the air/fuel ratio learning correction value, it is preferred that the weighted mean of the deviation of the air/fuel ratio feedback correction value from the target convergent value and the air/fuel ratio learning correction values stored according to the corresponding driving region be determined and the obtained mean be learned and stored as a new air/fuel ratio learning correction value in the corresponding driving region.

In accordance with another aspect of the present invention, there is provided an apparatus for learning and controlling the air/fuel ratio in an internal combustion engine, which comprises engine-driving condition-setting means for detecting engine-driving conditions including at least a parameter participating in the quantity of air sucked in the engine, basic fuel supply quantity-setting means for setting a basic fuel supply quantity based on the engine-driving conditions detected by the engine-driving condition-detecting means, air/fuel ratio-detecting means for detecting the air/fuel ratio of an air/fuel mixture sucked in the engine, air/fuel ratio feedback correction value-setting means for comparing the air/fuel ratio detected by the air/fuel ratio-detecting means with the target air/fuel ratio and setting an air/fuel ratio feedback correction value for correcting the basic fuel supply quantity so as to bring the actual air/fuel ratio close to the target air/fuel ratio, rewritable air/fuel ratio learning correction value-storing means for storing an air/fuel learning correction value for correcting the basic fuel supply quantity for each of driving regions divided according to driving conditions, air/fuel ratio learning correction value-correcting means for learning the deviation of the air/fuel ratio feedback correction value from the target convergent value and correcting and rewriting the air/fuel learning correction value stored in the air/fuel ratio learning correction value-storing means so as to reduce said deviation, fuel supply quantity-setting means for setting a final fuel supply quantity based on the basic fuel supply quantity, the air/fuel ratio feedback correction value and the air/fuel ratio learning correction value of the corresponding driving region stored in the air/fuel ratio learning correction value-storing means, fuel supply-controlling means for controlling the driving of fuel supply means based on the fuel supply quantity set by said fuel supply quantity-setting means, and means for variably setting the target convergent value of the air/fuel ratio feedback correction value in said air/fuel ratio learning correction value-correcting means.

In the apparatus having the above-mentioned structure, when the air/fuel ratio learning correction value-correcting means learns the deviation of the air/fuel ratio feedback correction value from the target convergent value, the target convergent value is variably set by the means for variably setting the target convergent value and the air/fuel ratio feedback correction value coverages at the variably set target convergent value.

Since the air/fuel ratio feedback correction value is a correction value for feedback-controlling the actual air/fuel ratio to the target air/fuel ratio, by the learning for converging the air/fuel ratio feedback correction value to the target convergent value, the learning is performed in a direction reverse to the direction of the change of the target convergent value. Therefore, for example, if the target convergent value changes toward the fuel quantity-increasing side, the learning target value is changed to the fuel quantity-decreasing side. As the result, the learning is effected so that the target air/fuel ratio is obtained in a state where the air/fuel ratio feedback correction value coverages on the changed target convergent value.

Accordingly, by variably setting the target convergent value by means for variably setting the target convergent value, the learning target air/fuel ratio can be optionally changed without performing feedback control by changing the target air/fuel ratio actually.

In the above-mentioned structure, there can be arranged feedback correction value-clamping means so that when the correction of the air/fuel ratio learning correction value by the air/fuel ratio learning correction value-correcting means converges from the point of the changeover of the target convergent value by the means for variably setting the target convergent value, the air/fuel ratio feedback correction value in the air/fuel ratio feedback correction-value setting means is forcibly clamped to the initial value.

If the feedback correction value-clamping means is arranged, by variably setting the target convergent value, the final air/fuel ratio control point is determined by the result of the learning conducted with an air/fuel ratio different from the target air/fuel ratio of the feedback correction being as the target, and it becomes possible to perform learning and control while aiming for an air/fuel ratio other than the target air/fuel ratio of the feedback control.

Furthermore, the means for variably setting the target convergent value, can be constructed so that the target convergent value is variably set based on the revolution speed of the engine and the engine load. In this case, the basic air/fuel ratio can be made richer in a driving region where hesitation is readily caused.

Moreover, the means for variably setting the target convergent value can be constructed so that the target convergent value is variably set based on the engine temperature. In this case, for example, by changing the target convergent value to the fuel quantity-decreasing side when the engine is cold, learning is conducted in a state where an air/fuel ratio richer than the target air/fuel ratio is aimed at, and it is possible to make the basic air/fuel ratio richer.

Still further, the means for variably setting the target convergent value can be constructed so that a plurality of maps for storing in advance a target convergent value for each of driving regions are arranged and the target convergent value is variably set, based on a map selected from these maps according to the required basic air/fuel ratio. In this case, for one driving region, the learning can be conducted to different basic air/fuel ratios by selecting maps appropriately.

Still further, the means for variably setting the target convergent value can be constructed so that the target convergent is variably set based on whether or not the running speed of an engine-loaded vessel is constant. In this case, for example, when the vehicle runs at a constant speed, the basic air/fuel ratio can be made leaner.

Still, in addition, the air/fuel ratio learning correction value-correcting means can be constructed so that a weighted mean of the deviation of the air/fuel ratio feedback correction value from the target convergent value and the air/fuel ratio learning correction value stored according to the corresponding driving region is determined and rewriting of the air/fuel ratio learning correction value in the learning correction value-storing means is performed so that the weighted mean is a new air/fuel ratio learning correction value.

If the learning correction value is rewritten and corrected to the weight mean in the above-mentioned manner, stable learning becomes possible.

Other objects and features of the present invention will become apparent from the following description made with reference to embodiments illustrated in the accompanying drawings.

DETAILED DESCRIPTION OF THE PREFERRED EMBODIMENTS

Figure 1:
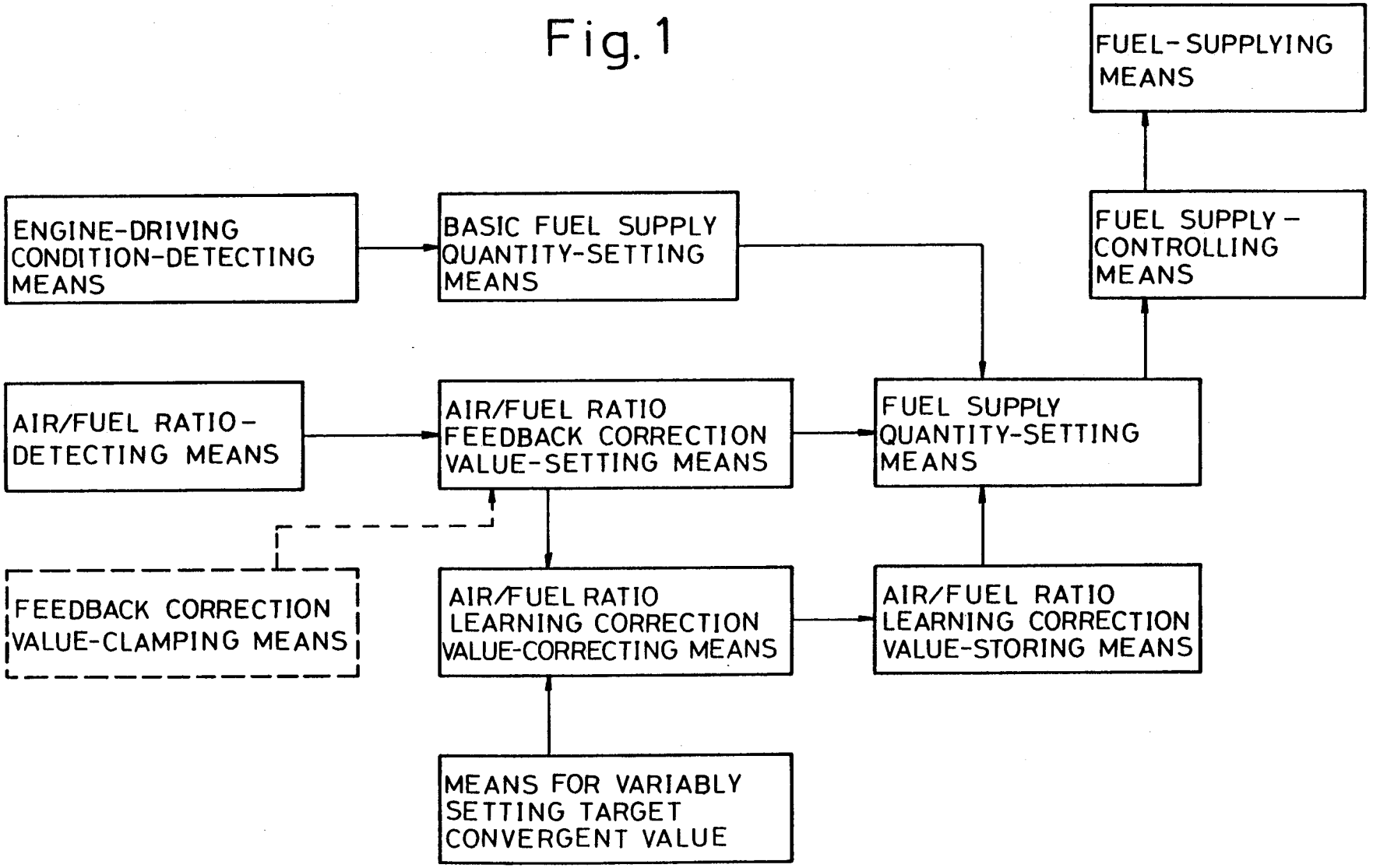
FIG. 1 is a block diagram illustrating the structure of the apparatus for learning and correcting an air/fuel ratio in an internal combustion engine according to the present invention.

The structure of the above-mentioned apparatus for learning and controlling an air/fuel ratio in an internal combustion engine according to the present invention is shown in FIG. 1, and an embodiment of the process and apparatus for learning and controlling an air/fuel ratio in an internal combustion engine according to the present invention is illustrated in FIGS. 2 through 7.

Figure 2:
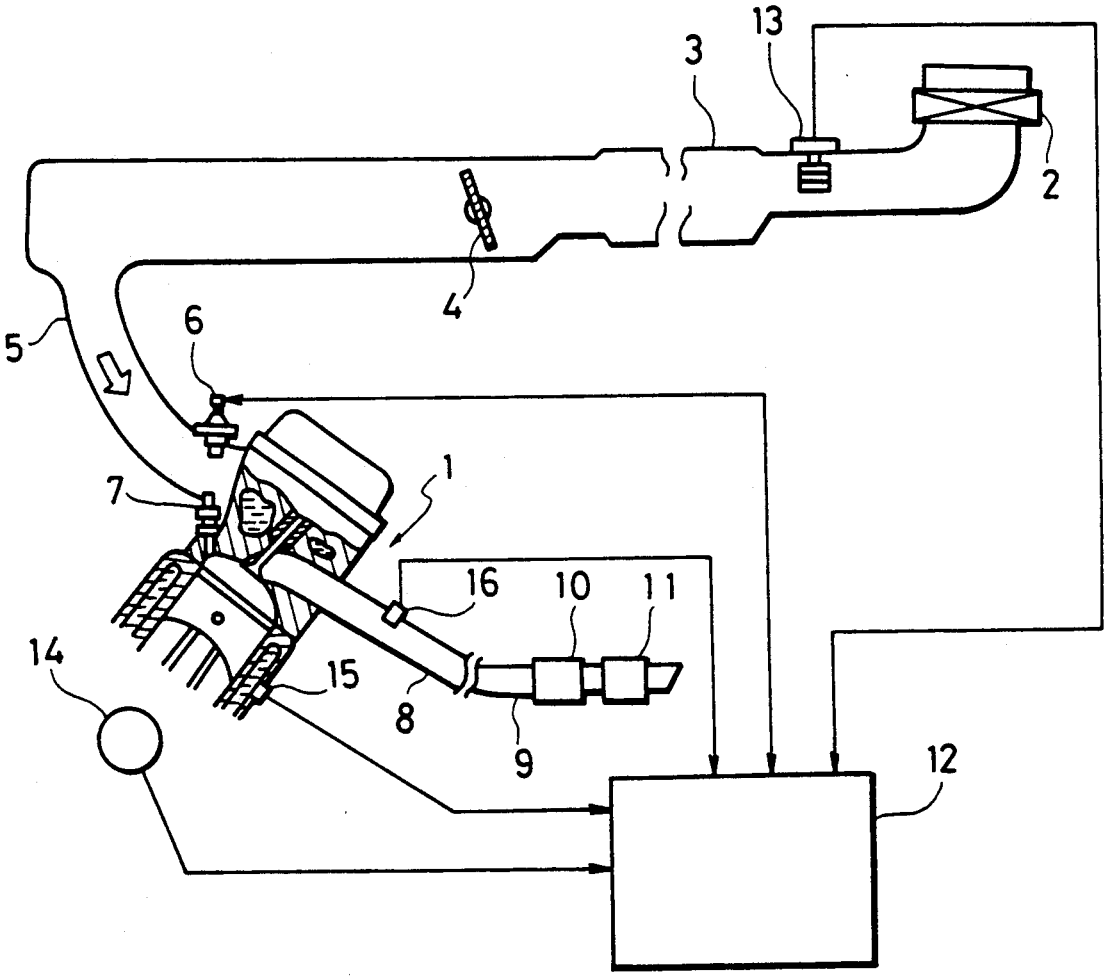
FIG. 2 is a system diagram illustrating one embodiment of the process and apparatus for learning and controlling an air/fuel ratio in an internal combustion engine according to the present invention.

Referring to FIG. 2 illustrating one embodiment of the present invention, air is sucked into an internal combustion engine 1 from an air cleaner 2 through a suction duct 3, a throttle valve 4 and a suction manifold 5. Fuel injection valves 6 are arranged at a branch portion of the suction manifold 5 as fuel supply means for respective cylinders. Each fuel injection valve 6 is an electromagnetic fuel injection valve of the normally closed type which is opened by actuation of a solenoid and is closed when application of electricity to the solenoid is stopped. The fuel injection valve 6 is actuated and opened by a driving pulse signal from a control unit 12 described below, and a fuel fed under pressure from a fuel pump not shown in the drawings and having a pressure adjusted to a predetermined level by a pressure regulator is injected and supplied.

An ignition plug 7 is arranged in a combustion chamber of the engine 1, and an air/fuel mixture is ignited and burnt by spark ignition by the ignition plug 7.

An exhaust gas is discharged from the engine 1 through an exhaust manifold 8, an exhaust duct 9, a ternary catalyst 10 and a muffler 11.

The control unit 12 comprises a microcomputer provided with CPU, ROM, RAM and A/D converter and an input/output interface, and the control unit 12 receives input signals from various sensors and performs computing processing as described below to control the operation of the fuel injection valve.

The various sensors will now be described. An air flow meter 13 is arranged in the suction duct 3 to output a signal corresponding to the quantity Q of air sucked in the engine 1.

A crank angle sensor 14 is arranged to output a reference signal REF at every 180° of crank angle and a unit signal POS at every 1° or 2° of crank angle, in the case of a 4-cylinder engine. The revolution number N of the engine can be calculated by measuring the frequency of the reference signal REF, or the number of unit signals POS occurring during a predetermined time.

A water temperature sensor 15 is arranged in a water jacket of the engine 1 to detect the cooling water temperature Tw representing the engine temperature.

The above-mentioned air flow meter 13, crank angle sensor 14 and water temperature sensor 15 and the like correspond to the engine-driving condition-detecting means.

An oxygen sensor 16 is arranged as the air/fuel ratio-detecting means in an assembly portion of the exhaust manifold 8 to detect the air/fuel ratio of a sucked air/fuel mixture through the oxygen concentration. The oxygen sensor 16 is a known sensor for detecting whether the actual air/fuel ratio is richer or leaner than the theoretical air/fuel ratio (target air/fuel ratio), by utilizing the phenomenon that the oxygen concentration in the exhaust gas abruptly changes with the theoretical air/fuel ratio being as the boundary.

The CPU of the microcomputer built into the control unit 12 performs the air/fuel ratio feedback correction control and air/fuel ratio learning correction control by carrying out the computing processing according to programs on ROM, shown in flow charts of FIGS. 3 through 6, respectively, to set the fuel injection quantity Ti and control the supply of the fuel to the engine 1.

In the present embodiment, the functions of the basic fuel supply quantity-setting means, air/fuel ratio feedback correction value-setting means, air/fuel ratio learning correction value-correcting means, fuel supply quantity-setting means, fuel supply-controlling means, means for variably setting the target convergent value and feedback correction value-clamping means are arranged as soft wares as shown in FIGS. 3 through 6. RAM provided with a backup function, arranged in the microcomputer built in the control unit 12, corresponds to the air/fuel ratio learning correction value-storing means.

Figure 3:
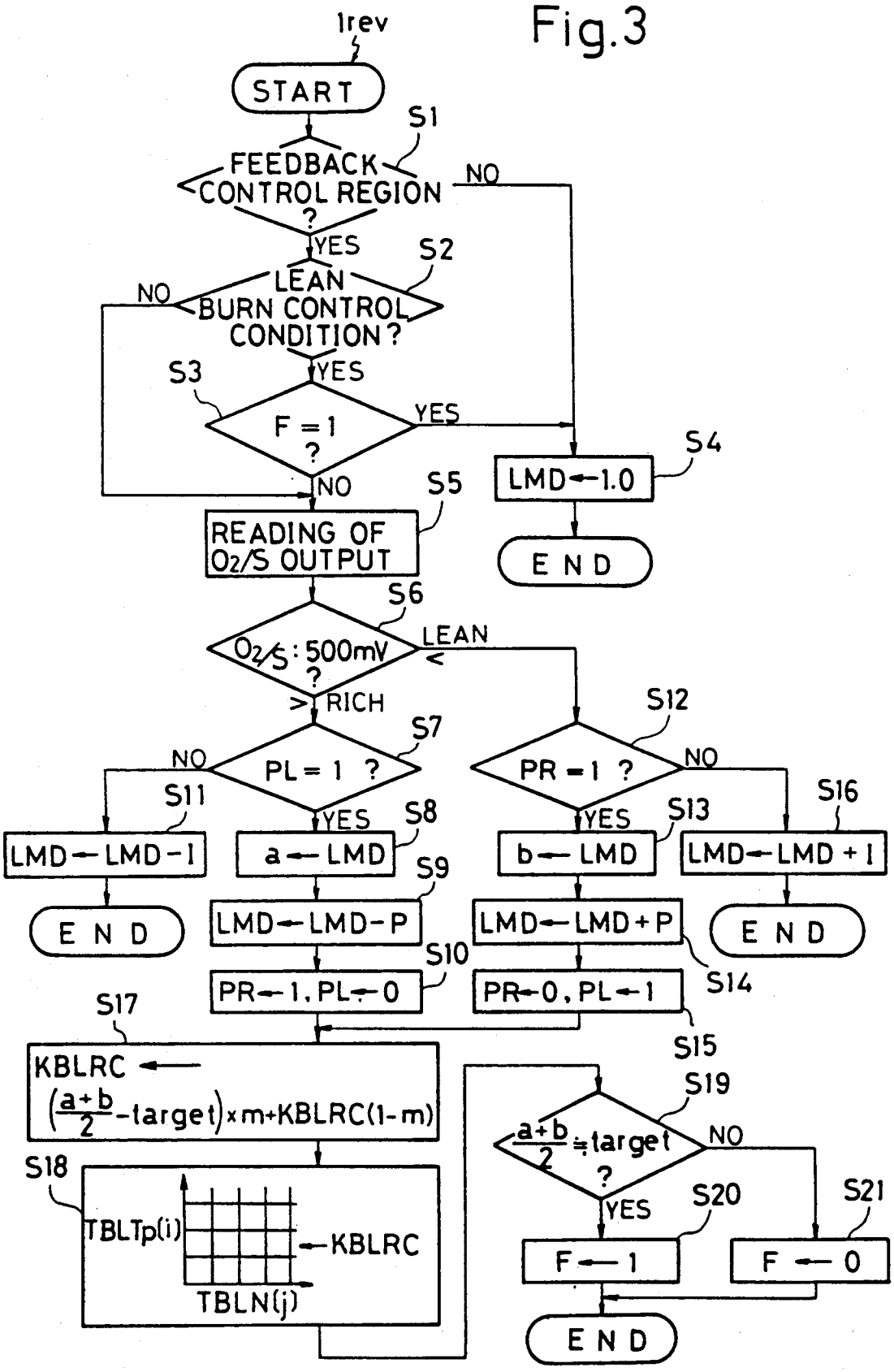
FIG. 3 through 6 are flow charts showing the contents of controls concerning the supply of fuel in the above-mentioned embodiment.

The program shown in the flow chart of FIG. 3 is a program for performing proportional-integral control of the air/fuel ratio feedback correction coefficient LMD (the initial value is 1.0) as the air/fuel ratio feedback correction value based on the result of the rich-/lean detection of the air/fuel ratio and learning the deviation of the air/fuel ratio feedback correction coefficient LMD from the target convergent value target for each driving region to set the air/fuel ratio learning-correction coefficient KBLRC (the initial value is zero).

The program shown in FIG. 3 is practiced at every revolution (1 rev) of the engine. At first, at step 1 (S1 in the drawings; subsequent steps are shown in the same manner), it is judged whether or not the present driving conditions are those of the driving region where the feedback control of the air/fuel ratio is carried out. In the region of the air/fuel ratio feedback control, the basic fuel injection quantity (basic fuel supply quantity) Tp ($\leftarrow K \times Q/N$; K is a constant) calculated based on the sucked air flow quantity Q and engine revolution number N, and the engine revolution number N are preliminarily set as parameters, and based on the newest basic fuel injection quantity Tp and engine revolution number N, it is judged whether or not the present region is the air/fuel ratio feedback control region.

When it is judged that the driving conditions are those for performance of the air/fuel ratio feedback control, the routine goes into step 2, and it is judged whether or not the condition for the lean burn control is established. In contrast to the ordinary control of adjusting the air/fuel ratio to the theoretical air/fuel ratio or a level richer than the theoretical air/fuel ratio, the lean burn control referred to herein is the control of adjusting the air/fuel ratio to a level leaner than the theoretical air/fuel ratio to improve the fuel consumption characteristics. For example, in the state after termination of the warming driving where the cooling water temperature Tw is higher than a predetermined temperature, if the running speed VSP of the vehicle having the engine 1 loaded thereon is constant, it is judged that the condition for the transfer to the lean burn control is established.

When it is judged at step 2 that the condition for the lean burn control is established, the routine goes into step 3, and it is judged whether or not flag F is 1.

When learning of the air/fuel ratio learning correction coefficient KBLRC (air/fuel ratio learning correction value) is sufficiently advanced and the air/fuel ratio feedback correction coefficient LMD converges in the vicinity of the target convergent value target, 1 is set at flag F, and when the learning is insufficient and the correction coefficient LMD has a deviation from the target convergent value target, 0 is set at flag F.

When the corresponding driving region of a plurality of driving regions divided by the basic fuel injection quantity Tp and engine revolution number N, as described hereafter, is changed, zero is reset at flag F, and, therefore, if Tp and N are stable and learning of the air/fuel ratio is sufficiently advanced under this driving condition, 1 is set at flag F.

If it is judged at step 3 that flag F is 1, the routine goes into step 4, the initial value of 1.0 is set at the air/fuel ratio feedback correction coefficient LMD and LMD is clamped at the at the initial value, so that the air/fuel ratio correction control is performed only by the air/fuel ratio learning correction coefficient KBLRC without the correction (feedback correction to the theoretical air/fuel ratio) by the air/fuel ratio feedback correction coefficient LMD, and as described hereinafter, when the lean burn control condition is established and the routine goes into step 4, the lean air/fuel ratio correction control corresponding to the change of the correction requirement for each driving condition is performed by the air/fuel ratio learning correction coefficient KBLRC.

Incidentally, also when it is judged at step 1 that the driving condition is one where the air/fuel ratio feedback control is not performed, the routine goes into step 4, and the feedback control to the theoretical air/fuel ratio is cancelled.

On the other hand, when it is judged at step 2 that the lean burn control condition is not established or it is judged at step 3 that flag F is not 1, the routine goes into step 5 onward, the proportional-integral control of the air/fuel ratio feedback correction coefficient LMD is performed and the feedback control to the theoretical air/fuel ratio is carried out.

At step 5, a voltage signal outputted from an oxygen sensor ($O_2$/S) 16 according to the oxygen concentration in the exhaust gas is read.

At step 6, the output of the oxygen sensor 16 read at step 5 is compared with a slice level value corresponding to the theoretical air/fuel ratio (target air/fuel ratio), and it is judged whether the air/fuel ratio of the present sucked air/fuel mixture is richer or leaner than the theoretical air/fuel ratio.

When it is judged at step 6 that the present air/fuel ratio is richer than the theoretical air/fuel ratio, it is judged at step 7 whether or not the rich value is first detected, based on whether or not flag PL is 1. Since 1 is set at flag FL at step 15 at the first detection of the lean value, if PL=1 is judged at step 7, it is indicated that the lean value has been detected at the preceding run and the rich value is initially detected at the present run.

In case of the first detection of the rich value where PL=1 is judged at step 7, the air/fuel ratio feedback correction coefficient LMD obtained at the preceding run is set at a maximum value a at step 8. In the lean value-detecting state, the control of increasing the air/fuel ratio feedback correction coefficient LMD is performed to obviate the lean air/fuel ratio state by the correction of increasing the fuel quantity, while in case of the detection of the rich value, the control of decreasing the correction coefficient LMD is performed to obviate the rich state by the correction of decreasing the fuel quantity. Accordingly, at the initial detection of the rich value, the maximum value of the correction coefficient LMD is attained.

At next step 9, a predetermined proportional portion P is subtracted from the air/fuel ratio feedback correction coefficient LMD at the precedent run, and the correction coefficient LMD is decreased and renewed by the proportional control. At step 10, zero is set at flag PL which has been judged as 1 at step 7, while 1 is set at flag PR used for the initial direction of the lean value.

When it is judged at step 7 that PL is not equal to 1, the judgement of the rich state is continued, and in this case, the routine goes into step 11 and a predetermined integral portion 1 is subtracted from the air/fuel ratio feedback correction coefficient LMD to gradually decrease and renew the correction coefficient LMD by the integral control.

When it is judged at step 6 that the air/fuel ratio is leaner than the theoretical air/fuel ratio, the routine goes into step 12 and it is judged whether or not flag PR is 1. When flag PR is 1, this indicates initial detection of the lean value, and in this case, the correction coefficient LMD decreased at the precedent run for obviating the rich state is set at a minimum value b.

At next step 14, the predetermined proportional portion P is added to the correction coefficient LMD at the precedent run to increase and renew the correction coefficient LMD by the proportional control. At next step 15, zero is set at flag PR judged as 1 at step 12, and 1 is set at flag PL for judging initial detection of the rich value after elimination of the lean state.

Furthermore, when it is judged at step 12 that flag PL is not 1 and the lean state is continued, the routine goes into step 16 and the predetermined integral proportion 1 is added to the correction coefficient at the precedent run and the correction coefficient LMD is gradually increased and renewed by the integral control.

When the correction coefficient LMD is thus increased or decreased by the proportional control at the initial direction of the rich or lean value, the routine goes into step 17 and the learning correction coefficient KBLRC corresponding to the present driving region is renewed and set according to the following formula so that the air/fuel ratio learning correction coefficient (air/fuel ratio learning correction value) KBLRC is learned in a direction of decreasing the deviation of the air/fuel ratio feedback correction coefficient LMD from the target convergent value target:

$$KBLRC \leftarrow [(a+b)/2 - \text{target}] \times m + KBLRC(1-m)$$

The weighted mean of the deviation between the median value (a+b)/2 of the newest correction coefficient LMD and the target convergent value target of the correction coefficient LMD and the air/fuel ratio learning correction coefficient KBLRC is calculated by using a weighting constant m according to the above-mentioned calculation formula, and the air/fuel ratio learning correction coefficient KBLRC is determined as the deviation between the median value of the correction coefficient LMD and the target convergent value target.

The air/fuel ratio learning correction coefficient KBLRC calculated at step 17 is used at step 18 as new data of the corresponding driving region in the map among a plurality of driving regions divided by the engine revolution number N and basic fuel injection quantity Tp as parameter of the driving condition, and thus, renewal of the map data is effected. Accordingly, the learning correction coefficient KBLRC used for obtaining the weighted mean with (a+b)/2 according to the above-mentioned calculation formula is the data of the corresponding driving region stored with Tp and N as the parameters.

When the air/fuel ratio feedback correction coefficient LMD is the initial value of 1.0, increase or decrease correction of the basic fuel injection quantity Tp is not carried out, and when LMD exceeds 1.0, increase correction of Tp is carried out and when LMD becomes smaller than 1.0, decrease correction of Tp is carried out. Accordingly, if the target convergent value target is set at 1, the air/fuel ratio learning correction coefficient KBLRC is learned for controlling the basic air/fuel ratio to the theoretical air/fuel ratio.

Figure 7:
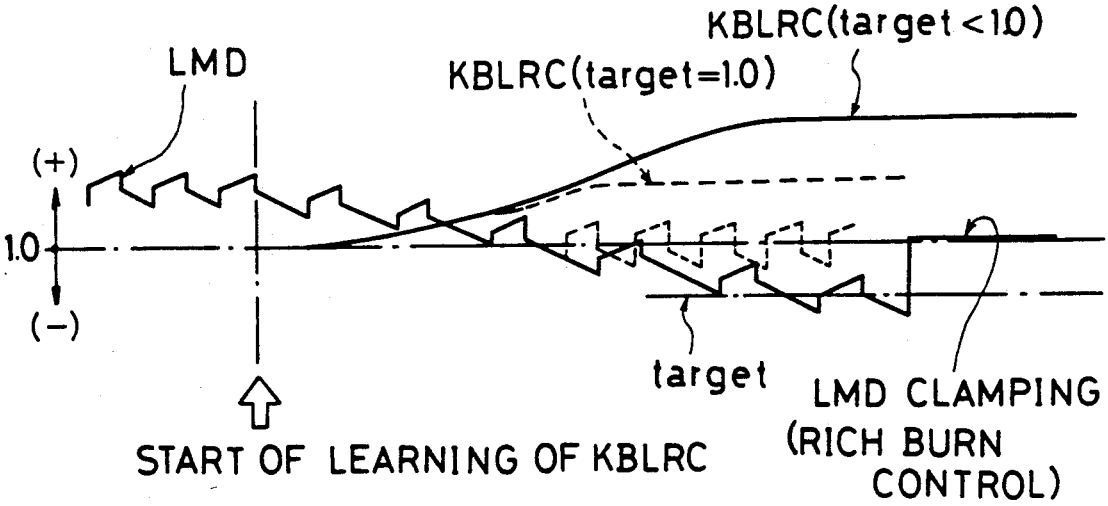
FIG. 7 is a time chart showing the the characteristics of the air/fuel ratio feedback correction and air/fuel ratio learning correction in the above-mentioned embodiment.

In contrast, if the target convergent value target of the correction coefficient LMD is set at a value smaller than 1.0, the learning is performed so that the air/fuel ratio feedback correction coefficient LMD converges at the target convergent value target smaller than 1.0. As the result, as shown in FIG. 7, the learning is performed so that the theoretical air/fuel ratio is obtained by the balance between the decrease correction by the correction coefficient LMD and the increase correction by the air/fuel ratio learning correction coefficient. Therefore, if the correction coefficient LMD is clamped at the initial value, by the increase correction of the basic fuel injection quantity Tp by the correction coefficient LMD, the air/fuel ratio is corrected and controlled to a value richer than the theoretical value by the same proportion as the proportion by which the target convergent value target is smaller than 1.0.

In contrast, if the target convergent value is set at a value larger than 1.0, without the correction by the correction coefficient LMD, the actual air/fuel ratio is controlled to a lean level by the air/fuel ratio learning correction coefficient KBLRC.

As is apparent from the foregoing description, by setting the abovementioned target convergent value target, the basic air/fuel ratio obtained without the correction by the correction coefficient LMD can be optionally leaned and controlled. In the present embodiment, the target convergent value target is variably set according to the engine-driving condition by the program shown in FIG. 4.

Figure 4:
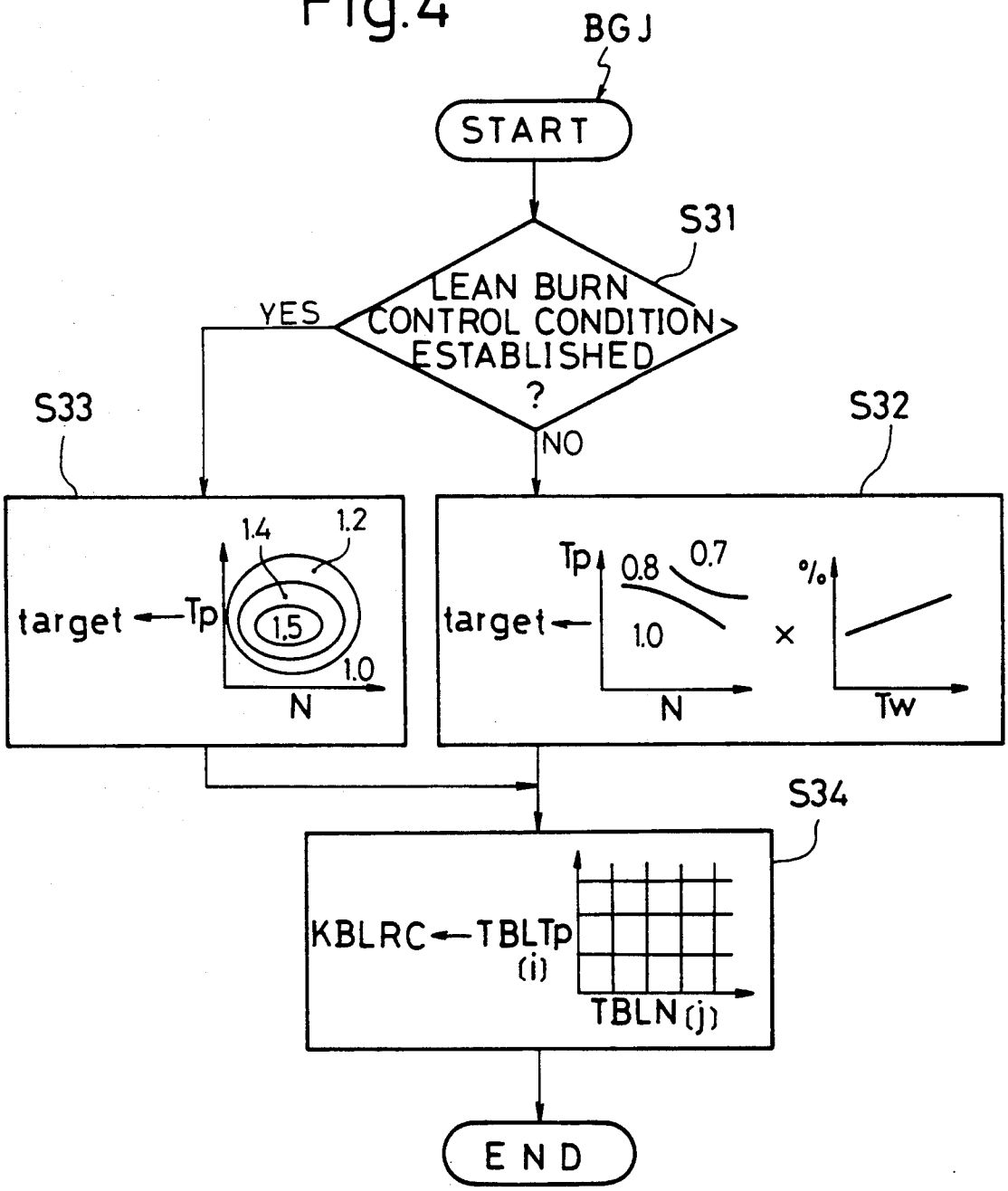

The program shown in FIG. 4 is one for background processing. At step 31, it is judged whether or not the lean burn condition is established. The lean burn condition includes, for example, a constant vehicle speed VSP and a cooling water temperature Tw lower than a predetermined level, as mentioned hereinbefore. When the lean burn control condition is not established, the routine goes into step 32 and the target convergent value target is set so that ordinary learning is carried out toward the theoretical air/fuel ratio or an air/fuel ratio richer than the theoretical air/fuel ratio.

At step 32, from the map where the target convergent value target is stored in advance by using the engine revolution number N and the basic fuel injection quantity Tp representing the engine load as the parameters of the driving condition, the target convergent value target corresponding to the present engine revolution number N and basic fuel injection quantity Tp is retrieved, and from the map where the correction coefficient of the target convergent value target is stored according to the cooling water temperature Tw representing the engine temperature, the correction coefficient corresponding to the present cooling water temperature Tw is retrieved. The target convergent value target retrieved from the map based on N and Tp is multiplied by the correction coefficient corresponding to the cooling water temperature Tw, and the obtained value is set as the target convergent value target corresponding to the present driving condition.

Incidentally, in the present embodiment, as shown in the flow chart of FIG. 4, in the low-revolution low-load region of the engine 1, the target convergent value target is set at 1.0, the target convergent value target is set at 0.8 in the medium-revolution medium-load region, and the target convergent value target is set at 0.7 in the high-revolution high-load region. Thus, the target convergent value target is set so that learning is effected to the basic air/fuel ratio meeting the requirement for each of the driving regions divided by the engine revolution number N and basic fuel injection quantity Tp, and the target convergent value target is further corrected by the cooling temperature Tw to cope with the change of the required basic air/fuel ratio between the case of a low water temperature and the case of a high water temperature.

Accordingly, prevention of hesitation by correction and control of the basic air/fuel ratio to a richer level and improvement of the characteristics of the exhaust gas can be easily accomplished by changing map data characteristics of the target convergent value target.

When it is judged at step 31 that the lean burn condition is established, the routine goes into step 33, the target convergent value target ($>1.0$) for the lean burn control is set. Also in this case, the target convergent value target is preliminarily set in the map by using the engine revolution number N and basic fuel injection quantity Tp as parameters of the driving condition, and the lean degree of the air/fuel ratio required for each of the driving regions according to N and Tp at the lean burn control is set.

Incidentally, in the present embodiment, as shown in the flow chart of FIG. 4, for the target convergent value target set when the lean burn control condition is established, a largest value is set in the medium-revolution medium-load region, and the target convergent target is brought close to 1 as the driving region separates from the central region.

In the above-mentioned manner, the target convergent value target is variably set according to the driving condition or the required basic air/fuel ratio, and since the basic air/fuel ratio can be easily set only by changing the map data, that is, ROM data, the change of the required basic air/fuel ratio can be easily coped with by simple processing, and any change of a hardware or the like is not necessary.

In the above-mentioned manner, according to whether or not the lean burn condition is established (required basic air/fuel ratio), one map is selected from the two maps of target convergent values and the target convergent value target is set according to the driving condition including the engine revolution number N and basic fuel injection quantity Tp (further with the cooling water temperature Tw). At next step 34, by using this target convergent value target, the air/fuel ratio learning correction coefficient KBLRC, corresponding to the present Tp and N, is retrieved from the map where the air/fuel ratio learning correction coefficient KBLRC is renewed and stored by using Tp and N as the parameters, and the retrieved value obtained at this step is used for calculation of the final fuel injection quantity Ti and computation of the weighted mean.

Referring to the flow chart of FIG. 3 again, if map data of the air/fuel ratio learning correction coefficient KBLRC are rewritten at step 18 based on the air/fuel ratio learning correction coefficient KBLRC calculated at step 17, at next step 19, it is judged whether or not the median value $[=(a+b)/2]$ of the air/fuel ratio feedback correction coefficient LMD is substantially in agreement with the target convergent value target.

When it is judged at this step that the median value of the air/fuel ratio feedback correction coefficient LMD is substantially in agreement with the target convergent value target, the learning of the air/fuel ratio learning correction coefficient KBLRC is sufficiently advanced, and in this case, the routine goes into step 20 and 1 is set at flag F. When the median value of the air/fuel ratio feedback correction coefficient LMD is not substantially in agreement with the target convergent value target, the advance of the learning is insufficient, and in this case, the routine goes into step 21 and zero is set at flag F.

Figure 5:
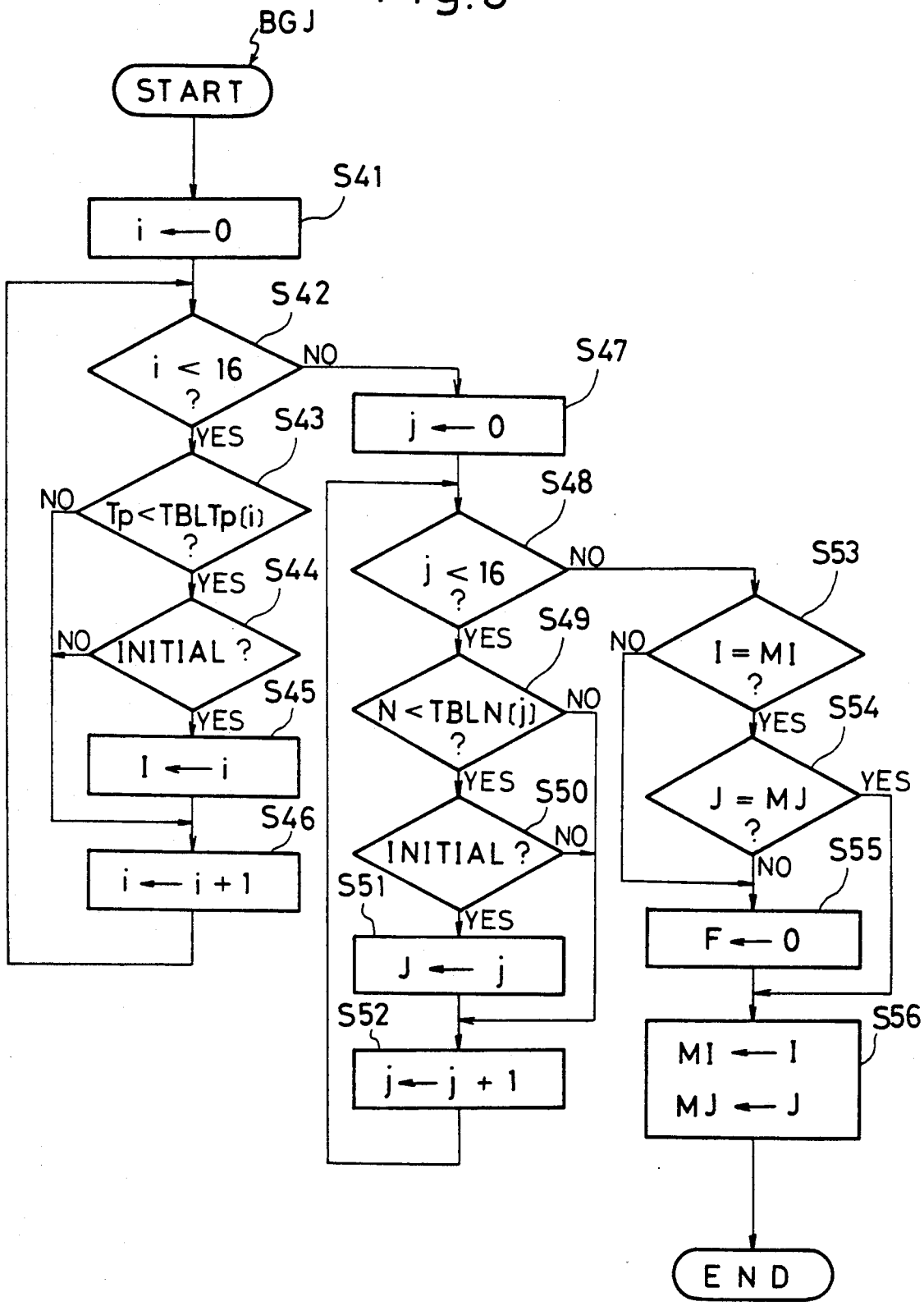

The above-mentioned flag F can also be reset at zero according to a program shown in the flow chart of FIG. 5.

The program shown in the flow chart of FIG. 5 is for the background processing. At step 41, a counter i for counting the lattice position of Tp in a map where Tp and N are used as the parameters is set at zero, and at next step 42, whether or not processing of confirming Tp lattices 0 through 15 is performed is judged based on whether or not the value of the counter i is smaller than 16.

When the value of the counter i is smaller than 16, the routine goes into step 43, TBLTp[i] which is maximum Tp at the Tp lattice position indicated by the counter i is compared with the most newly computed basic fuel injection quantity Tp, and when it is judged that Tp is smaller than TBLTp[i], it is judged at step 44 whether or not this judgement is initially made. In case of the initial judgement, the routine goes into step 45, the value of the counter i is set at 1, which indicates that the lattice position I corresponds to the newest basic fuel injection quantity Tp.

At step 46, the value of the counter i is increased by one, and the routine comes back to step 42. Then, when the value of the counter i is increased to 16 from 0, the routine goes into step 47 from to step 42, and the lattice position J of the map corresponding the newest engine revolution number N is similarly determined by using a counter j (steps 47 through 52).

If the lattice position (I, J) of the driving region including the newest basic fuel injection quantity Tp and engine revolution number N is specified in the above-mentioned manner, at step 53, MI determined as the lattice position corresponding to the basic fuel injection quantity Tp at the preceding run of the present program is compared with the lattice position determined at the present run, and it is judged whether or not the lattice position I including the basic fuel injection quantity Tp is changed.

When the lattice position I including the basic fuel injection quantity Tp is changed, the routine goes into step 55 and flag F is reset at zero. In contrast, in the case where the basic fuel injection quantity Tp remains at the specific lattice and I is equal to MI, the routine goes into step 54, and by comparing the lattice position J at the present run with the lattice position MJ at the precedent run, it is judged whether or not the lattice position J including the engine revolution number N is changed.

When the lattice position J including the engine revolution number N is changed, the routine goes into step 55, flag F is reset at zero. In contrast, when it is judged that the engine revolution number N remains at a specific lattice position, in this state the basic fuel injection quantity Tp and engine revolution number N are hardly changed. In this case, the routine skips step 55 and goes into step 56. Accordingly, flag F is not reset at zero, but if flag F is 1, this state is maintained.

At step 56, for the judgement at steps 43 and 54 at the subsequent run of the present program, the lattice position I of the basic fuel injection quantity I and the lattice position J of the engine revolution number N, specified at the present run, are set at MI and MJ, respectively.

Accordingly, 1 is set at flag F only when the basic fuel injection quantity Tp and engine revolution number N are stable and learning of the air/fuel ratio learning correction coefficient KBLRC is sufficiently advanced, and if it is judged at step 3 in the flow chart of FIG. 3 that flag F is 1, the target convergent value target for the lean burn control is set and the state is the stationary driving state in which the correction coefficient LMD converges on this target convergent value target. In this case, the routine goes into step 4, and the correction coefficient LMD is clamped at the initial value of 1.0.

Since the target convergent value target for the lean burn control is set at a value larger than 1.0, as mentioned above, the correction of increasing the fuel quantity by the feedback correction coefficient LMD is performed in this state and the air/fuel ratio learning correction coefficient KBLRC is learned, so that the actual air/fuel ratio becomes the theoretical air/fuel ratio for each driving region, but in each driving region, only by the air/fuel ratio learning correction coefficient KBLRC, the actual air/fuel ratio is corrected to a level leaner than the theoretical air/fuel ratio by the same proportion as the proportion by which the target convergent value target is larger than 1.0.

Accordingly, in the case where it is judged at step 3 that flag F is 1 and the routine goes into step 4, the air/fuel ratio is controlled to a lean value according to the variable setting characteristics of the target convergent value target at step 33 in the flow chart of FIG. 4 and also to the difference of the required correction quantity among the driving conditions.

Even when it is judged at step 2 that the lean burn control established, if it is judged at step 3 that flag F is zero, the air/fuel ratio learning correction coefficient KBLRC is learned so that the correction coefficient LMD converges on the target convergent value target, and the air/fuel ratio is feedback-controlled to the theoretical air/fuel ratio.

Figure 6:
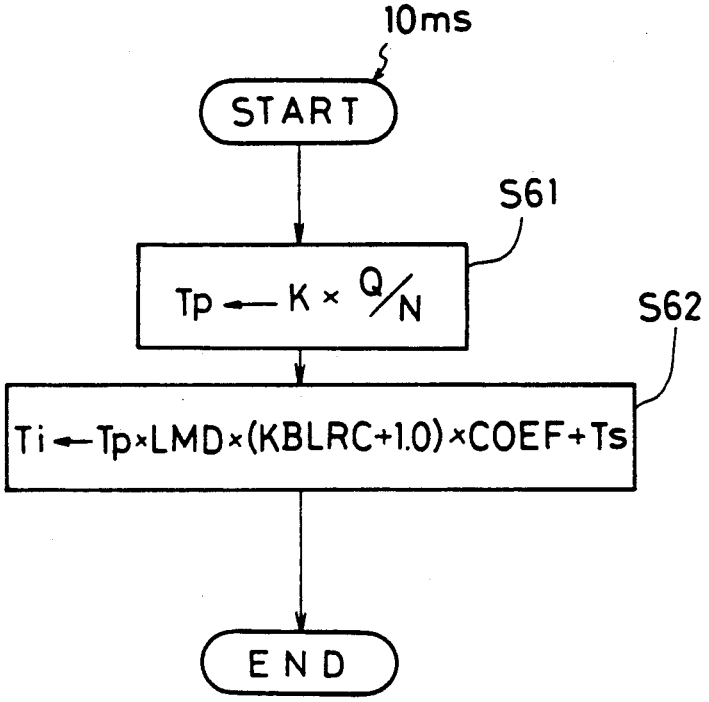

The air/fuel ratio feedback correction coefficient LMD and air/fuel ratio learning correction coefficient KBLRC set in the above-mentioned manner are used for computing and setting the fuel injection quantity Ti according to the program shown in the flow chart of FIG. 6.

The operation of the program shown in the flow chart of FIG. 6 is conducted at every predetermined micro time. AT step 61, the basic fuel injection quantity (basic fuel supply quantity Tp ($\leftarrow K \times Q/N$; K is a constant) is calculated based on the engine revolution number N calculated from the sucked air flow quantity Q detected by the air flow meter 13 and the detection signal from the crank angle sensor 14.

At next step 62, the basic fuel injection quantity Tp is corrected by the air/fuel ratio feedback correction coefficient LMD, the air/fuel ratio learning correction coefficient KBLRC, various correction coefficients COEF set based on the driving condition comprising mainly the cooling water temperature Tw and the voltage correction portion Ts for correcting the change of the effective injection time of the fuel injection valve 6 by the change of the battery voltage, whereby the final fuel injection quantity (fuel supply quantity) Ti is set, as shown by the following formula:

$$Ti \leftarrow Tp \times LMD \times (KBLRC + 1) \times \mathrm{COEF} + Ts$$

The fuel injection quantity Ti renewed and computed at every predetermined micro time is read out at a predetermined timing synchronous with the revolution of the engine and a driving pulse signal having a pulse width corresponding to the fuel injection quantity Ti is fed to the fuel injection valve 6 to open the fuel injection valve for a predetermined time and inject and supply the fuel to the engine 1.

In the present embodiment, the map of the air/fuel ratio learning correction coefficient KBLRC is commonly used for the lean burn control and the normal control of the air/fuel ratio, but there can be adopted a modification in which a plurality of maps of the air/fuel ratio learning correction coefficient KBLRC are arranged according to the number of the maps of the target convergent value target, and when a certain map of the target convergent value target is selected, the map of the air/fuel ratio learning correction coefficient KBLRC is exchanged with the corresponding map.

Moreover, as is obvious to persons with ordinary skill in the art, the map value of the target convergent value target may be variable according to the engine, and the target convergent value target can be changed only according to the engine irrespectively of the driving condition.

I claim:

1. A process for learning and controlling the air/fuel ratio in an internal combustion engine, which comprises setting a basic fuel supply quantity based on engine driving conditions including at least a parameter participating in the quantity of air sucked in the engine, comparing the air/fuel ratio of an air/fuel mixture actually sucked in the engine with the target air/fuel ratio, setting an air/fuel ratio feedback correction value for correcting the basic fuel supply quantity so that the actual air/fuel ratio is brought close to the target air/fuel ratio, variably setting the target convergent value of the air/fuel ratio feedback correction value, learning an air/fuel ratio learning value for each driving region of the engine so as to reduce the deviation of the air/fuel ratio feedback correction value from the target convergent value, renewing the learned value, storing the renewed value, setting a final fuel supply quantity based on the basic fuel supply quantity, the air/fuel ratio feedback correction value and the air/fuel ratio learning correction value of the corresponding driving region, and controlling the supply of the fuel to the engine based on the set final fuel supply quantity.

2. A process for learning and controlling the air/fuel ratio in an internal combustion engine according to claim 1, wherein when learning correction of the air/fuel ratio learning correction value converges after changeover of the target convergent value, the air/fuel ratio feedback correction value is forcibly clamped at the initial value.

3. A process for learning and controlling the air/fuel ratio in an internal combustion engine according to claim 1, wherein the target convergent value is variably set based on the engine revolution number and engine load.

4. A process for learning and controlling the air/fuel ratio in an internal combustion engine according to claim 1, wherein the target convergent value is variably set based on the engine temperature.

5. A process for learning and controlling the air/fuel ratio in an internal combustion engine according to claim 1, wherein a plurality of maps where a target convergent value is stored according to a driving region of the engine are provided and the target convergent value is variably set according to the map selected based on the requirement of the basic air/fuel ratio among these maps.

6. A process for learning and controlling the air/fuel ratio in an internal combustion engine according to claim 1, wherein the target convergent value is variably set according to whether or not the running speed of a vehicle having the engine loaded thereon is constant.

7. A process for learning and controlling the air/fuel ratio in an internal combustion engine according to claim 1, wherein the weighted mean of the deviation of the air/fuel ratio feedback correction value from the target convergent value and the air/fuel ratio learning correction value stored according to the corresponding driving region is determined and the obtained mean is learned and stored as a new air/fuel ratio learning correction value in the corresponding driving region.

8. An apparatus for learning and controlling the air/fuel ratio in an internal combustion engine, which comprises engine-driving condition-detecting means for detecting engine-driving conditions including at least a parameter participating in the quantity of air sucked in the engine, basic fuel supply quantity-setting means for setting a basic fuel supply quantity based on the engine-driving conditions detected by the engine-driving condition-detecting means, air/fuel ratio-detecting means for detecting the air/fuel ratio of an air/fuel mixture sucked in the engine, air/fuel ratio feedback correction value-setting means for comparing the air/fuel ratio detected by the air/fuel ratio-detecting means with a target air/fuel ratio and setting an air/fuel ratio feedback correction value for correcting the basic fuel supply quantity so as to bring the actual air/fuel ratio close to the target air/fuel ratio, rewritable air/fuel ratio learning correction value-storing means for storing an air/fuel learning correction value for correcting the basic fuel supply quantity for each of driving regions divided according to driving conditions, air/fuel ratio learning correction value-correcting means for learning the deviation of the air/fuel ratio feedback correction value from the target convergent value and correcting and rewriting the air/fuel learning correction value stored in the air/fuel ratio learning correction value-storing means so as to reduce said deviation, fuel supply quantity-setting means for setting a final fuel supply quantity based on the basic fuel supply quantity, the air/fuel ratio feedback correction value and the air/fuel ratio learning correction value of the corresponding driving region stored in the air/fuel ratio learning correction value-storing means, fuel supply-controlling means for controlling the driving of fuel supply means based on the fuel supply quantity set by said fuel supply quantity-setting means, and means for variably setting the target convergent value of the air/fuel ratio feedback correction value in said air/fuel ratio learning correction value-correcting means.

9. An apparatus for learning and controlling the air/fuel ratio in an internal combustion engine according to claim 8, wherein feedback correction value-clamping means is arranged so that when the correction of the air/fuel ratio learning correction value by the air/fuel ratio learning correction value-correcting means converges from the point of the changeover of the target convergent value by the means for variably setting the target convergent value, the air/fuel ratio feedback correction value in the air/fuel ratio feedback correction-value setting means is forcibly clamped at the initial value.

10. An apparatus for learning and controlling the air/fuel ratio in an internal combustion engine according to claim 8, wherein the means for variably setting the target convergent value is constructed so that the target convergent value is variably set based on the engine revolution number and engine load.

11. An apparatus for learning and controlling the air/fuel ratio in an internal combustion engine according to claim 8, wherein the means for variably setting the target convergent value is constructed so that the target convergent value is variably set based on the engine temperature.

12. An apparatus for learning and controlling the air/fuel ratio in an internal combustion engine according to claim 8, wherein the means for variably setting the target convergent value is constructed so that a plurality of maps for storing in advance a target convergent value for each of driving regions are arranged and the target convergent value is variably set based on a map selected from these maps according to the required basic air/fuel ratio.

13. An apparatus for learning and controlling the air/fuel ratio in an internal combustion engine according to claim 8, wherein the means for variably setting the target convergent value is constructed so that the target convergent value is variably set based on whether or not the running speed of an engine-loaded vessel is constant.

14. An apparatus for learning and controlling the air/fuel ratio in an internal combustion engine according to claim 8, wherein the air/fuel ratio learning correction value-correcting means is constructed so that a weighted mean of the deviation of the air/fuel ratio feedback correction value from the target convergent value and the air/fuel ratio learning correction value stored according to the corresponding driving region is determined and rewriting of the air/fuel ratio learning correction value in the learning correction value-storing means is performed so that the weighted mean is a new air/fuel ratio learning correction value.

* * * * *